US006880702B1

(12) United States Patent
Colorado

(10) Patent No.: US 6,880,702 B1
(45) Date of Patent: Apr. 19, 2005

(54) FIREFIGHTER'S ROPE BAG AND RAPID DEPLOYMENT SYSTEM

(76) Inventor: Juancarlos Colorado, P.O. Box 2111, Petaluma, CA (US) 94953

( * ) Notice: Subject to any disclaimer, the term of this patent is extended or adjusted under 35 U.S.C. 154(b) by 135 days.

(21) Appl. No.: 10/105,531

(22) Filed: Mar. 20, 2002

Related U.S. Application Data

(60) Provisional application No. 60/277,433, filed on Mar. 20, 2001.

(51) Int. Cl.[7] ..... B65D 85/00
(52) U.S. Cl. ..... 206/388; 206/702
(58) Field of Search ..... 206/349, 388, 206/702; 383/6, 19, 72, 74–76, 78, 84, 121, 383/125; 441/80, 84, 85

(56) References Cited

U.S. PATENT DOCUMENTS 1,261,846 A * 4/1918 Osggod ..... 383/76
3,225,806 A * 12/1965 Pollak et al. ..... 383/76
3,676,882 A * 7/1972 Lindqvist ..... 441/85
3,977,448 A * 8/1976 Botting ..... 383/75
4,232,808 A * 11/1980 Gray ..... 383/75
4,688,674 A * 8/1987 Stirtz ..... 206/388
4,713,033 A * 12/1987 Cameron ..... 441/84
4,974,709 A * 12/1990 Furlow et al. ..... 383/76
4,988,216 A * 1/1991 Lyman ..... 383/76
5,503,476 A * 4/1996 Hamdan ..... 383/9
6,499,519 B1 * 12/2002 Brown ..... 206/349

* cited by examiner

*Primary Examiner*—Luan K. Bui
(74) *Attorney, Agent, or Firm*—Craig M. Stainbrook; Larry D. Johnson; Johnson & Stainbrook, LLP

(57) ABSTRACT

A firefighter's rope bag and rapid deployment system having a fire retardant rope containment pouch with a closed top end and a bottom end with a pouch opening, closure means for selectively opening and closing said pouch opening, a load-bearing member enclosed by the rope containment pouch and having a top end and a bottom end, each with rope connection means, and a protective bonnet for selectively covering said pouch opening. The rope bag may be fastened to a trucker's belt and allows firefighters to rapidly deploy fire resistant rope for use in navigating and evacuating smoke-filled structures.

15 Claims, 6 Drawing Sheets

FIREFIGHTER'S ROPE BAG AND RAPID DEPLOYMENT SYSTEM

CROSS-REFERENCE TO RELATED APPLICATIONS

The present invention claims the benefit of the filing date of U.S. Provisional Patent application No. 60/277,433, filed Mar. 20, 2001.

BACKGROUND OF THE INVENTION

1. Field of the Invention

The present invention relates to safety and rescue extrication equipment, and more particularly to a firefighter's rope bag adapted for rapid deployment of fire resistant rope for use in navigating and evacuating smoke-filled structures.

2. Discussion of Related Art

Firefighting frequently requires rapid ingress and egress from burning, smoke-filled buildings. Reliably and accurately navigating burning structures can be made difficult, if not virtually impossible, by the urgency of rescue, blinding smoke-filled spaces, and the need to explore unknown labyrinthine layouts. It has therefore become a safety practice for firefighters to use a rope for guidance when entering a burning building. The rope is connected to an outside fixture or person and is then paid out as the firefighter enters the building. Should the firefighter become disoriented, he can use the rope for a sure route back out of the structure.

The present invention is an improved rope bag that provides a means for rapid deployment of safety rope and also comprises an auxiliary tool carrier.

BRIEF DESCRIPTION OF THE VARIOUS VIEWS OF THE DRAWINGS

SUMMARY OF THE INVENTION

Figure 1A:
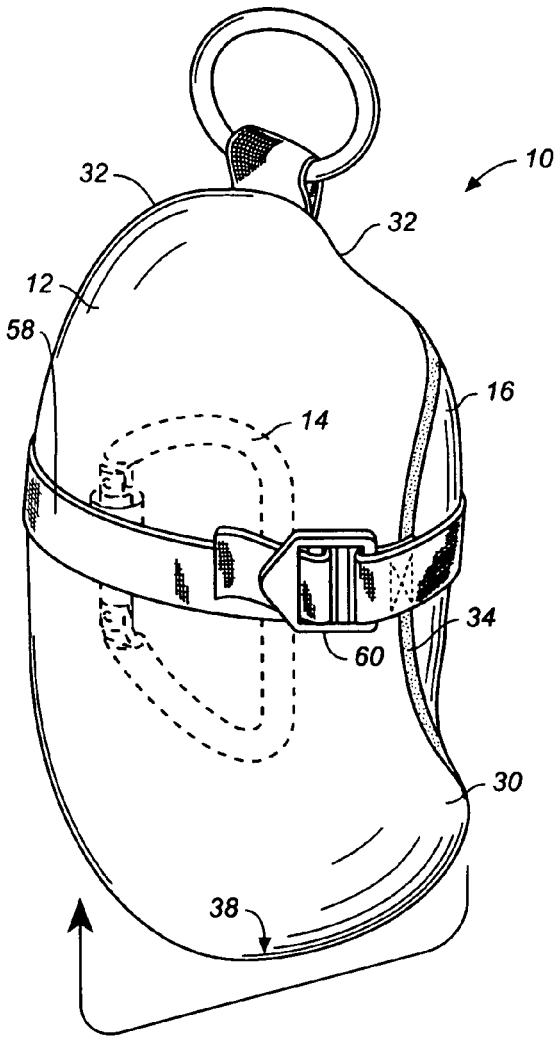
FIG. 1A is a front perspective view of the firefighter's rope bag of the present invention.
Figure 1B:
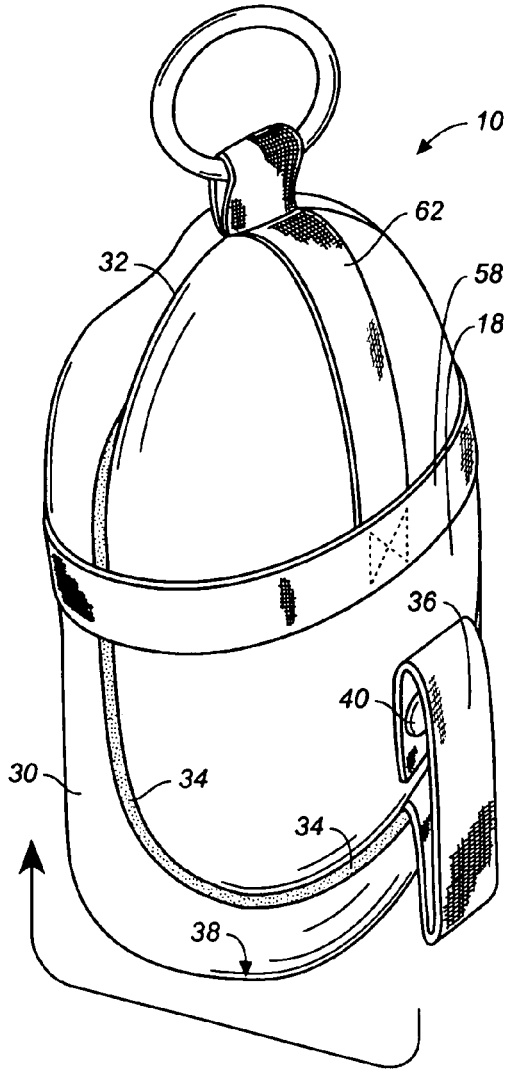
FIG. 1B is a back or rear elevation view of the rope bag of FIG. 1.
Figure 2:
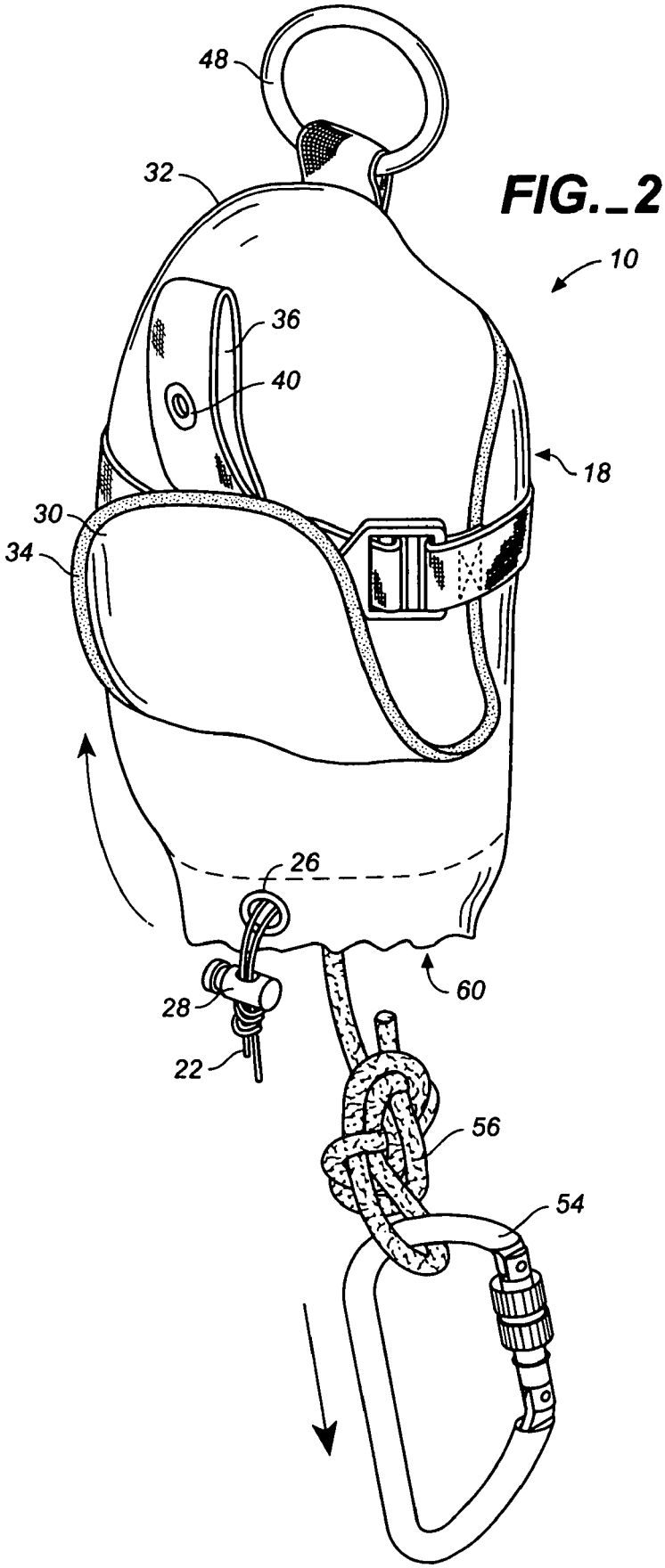
FIG. 2 is a perspective view of the rope bag of FIGS. 1A–B showing the rope bag open and a carabiner coupled to short length of fire resistant rope deployed therefrom.
Figure 3:
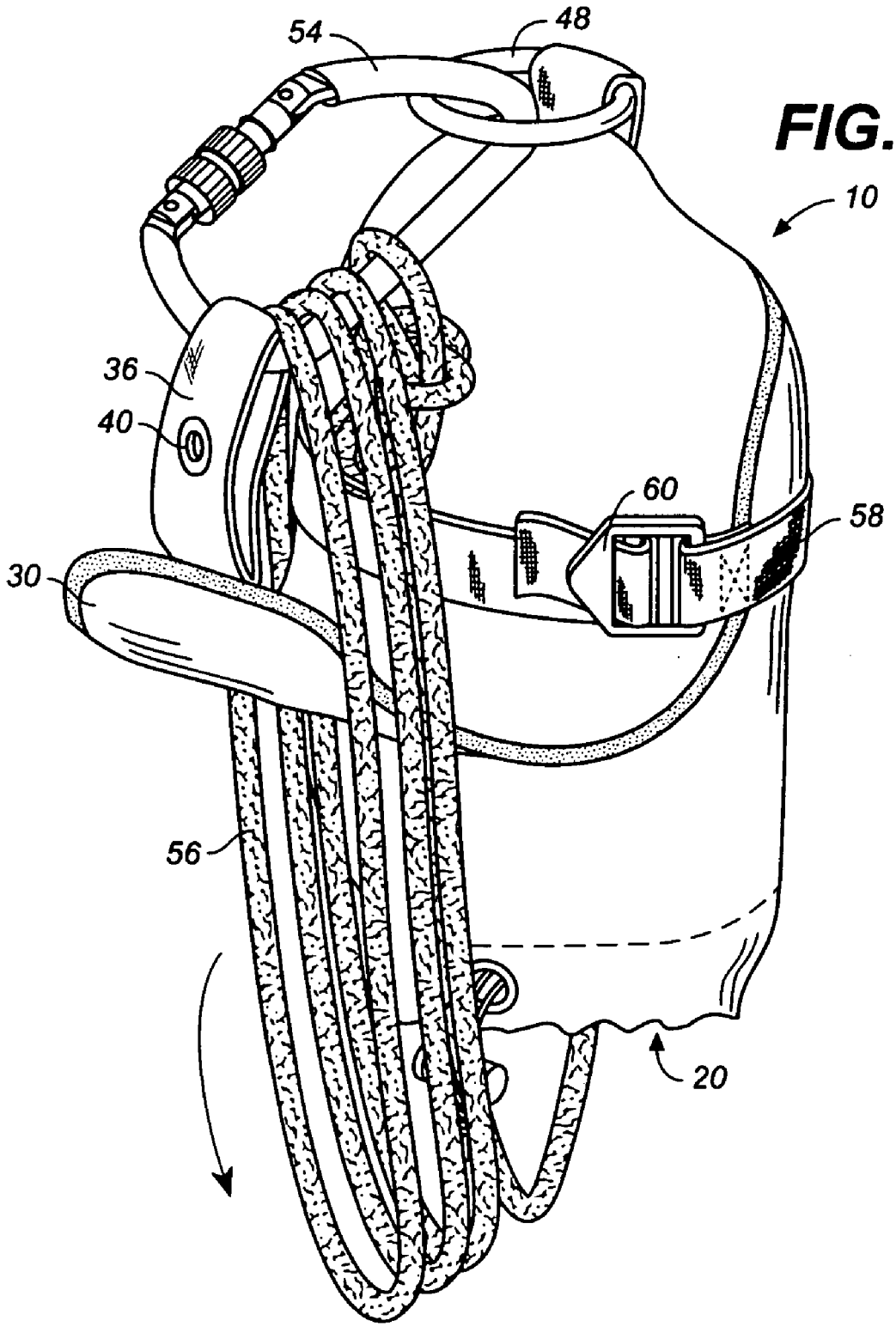
FIG. 3 is a perspective view of the rope bag of FIGS. 1A–2 showing the protective bonnet unsnapped and a substantial portion of the contained rope exposed.
Figure 4:
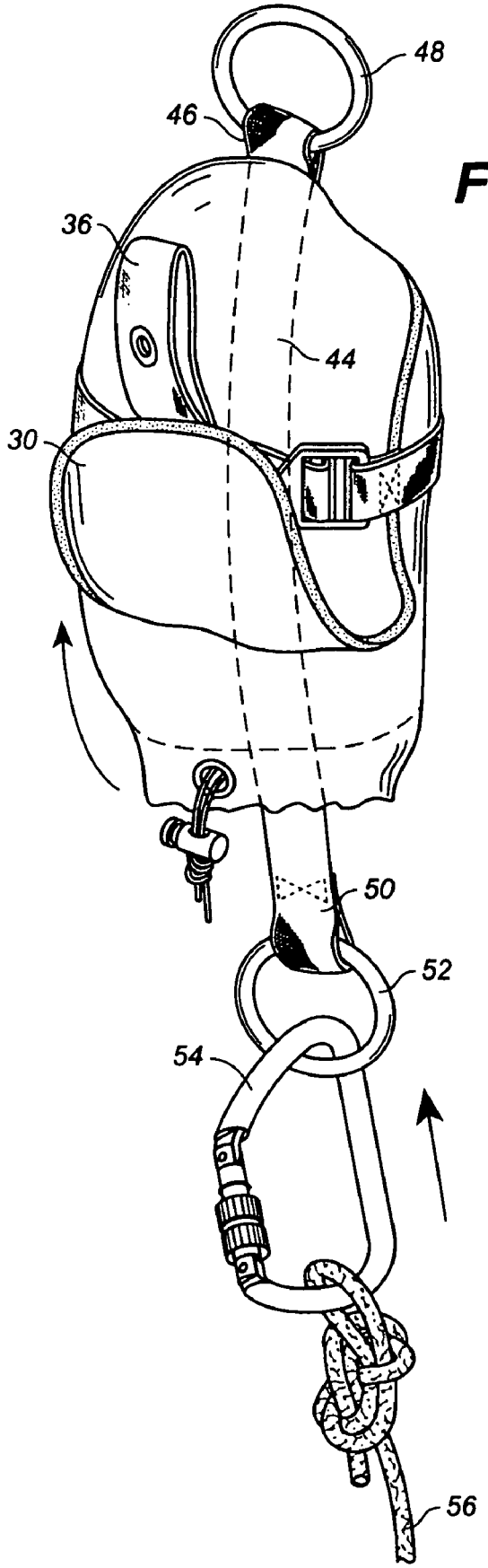
FIG. 4 is a front perspective view showing the contained rope fully deployed and a vertically disposed load-bearing strap extended below the bag opening.

Referring to FIG. 1A through FIG. 4, wherein like reference numerals refer to like components in the various views, FIG. 1 is a front perspective view of the improved firefighter's rope bag 10 of the present invention and FIG. 1B is a rear perspective view thereor; FIG. 2 is a perspective view of the rope bag of FIGS. 1A–B showing the rope bag open and a carabiner coupled to short length of fire resistant rope deployed therefrom; and FIG. 3 is a perspective view of the rope bag of FIGS. 1A–2 showing the protective bonnet unsnapped and a substantial portion of the contained rope exposed; finally, FIG. 4 is a front perspective view showing the contained rope fully deployed and a vertically disposed load-bearing strap extended below the bag opening. These views, collectively, show that the inventive apparatus comprises a rope pouch 12 for containment of a tightly coiled fire resistant rope and attached tools or devices, such as the carabiner 14 (shown in phantom). The pouch is preferably fabricated from two substantially symmetrical front and back halves 16, 18, of fire-resistant material tightly sewn together to form a pouch having a single compartment and an opening 20 at the bottom of the pouch, selectively closed and drawn together by a draw string 22 threaded through a sewn fabric loop 24 circumscribing the opening and fed out through a grommet 26. The string is secured by a push button spring tensioning clamp 28. Alternatively, the bag may be fabricated from a unitary section of fabric, as is well known in the art.

The bag further includes a bonnet 30 sewn into the pouch halves preferably at the top seam 32 of the pouch. The bonnet includes an elastic edge 34 which borders all but the portion sewn into the top seam. It further includes a fabric strap 36 at its bottom end 38 and a snap 40 for mating with a complementary snap (not shown) riveted to the back side 18 of the pouch. The elastic edge 34 of the bonnet allows it to be stretched over the bottom 42 of the rope compartment when the opening 20 is closed and the rope and any connected devices are contained within the compartment. When thus used, the bonnet completely covers the secured opening (see FIGS. 1A–B). The purpose of the bonnet is to protect the rope inside the bag from dirt, debris, water, and anything that might in any way entangle the rope or adversely affect its intentional deployment.

The bag further includes a plurality of fabric straps, the foremost comprising a vertically disposed load-bearing rope, cord, chain, or strap 44 (shown in phantom in FIG. 4) that runs contiguously through a sealed opening in the top of the pouch and into the pouch compartment, where it is folded or otherwise compacted for containment within the pouch. The load-bearing strap is preferably fabricated from aramid fiber (such as KEVLAR®) or a heavy weight, high pound test nylon. At its top end 46 the load-bearing strap 44 is looped and sewn around a first 4,000 pound test O-ring 48, which may be attached to a firefighter's trucker's belt or other extrication harness. When the bag is open (FIG. 4), the load-bearing strap 44 can be extended to a point proximate the bottom opening 20 of the bag where the bottom end 50 of the strap 44 is looped and sewn around a second heavy test O-ring attached 52, again for easy attachment to a carabiner 54 and/or rope 56.

A second, horizontally disposed fabric strap 58 circumscribes the pouch at approximately its midsection. This strap includes a buckle 60 positioned over the front pouch section 16 and the bonnet 30 so that the containment compartment of the pouch can be adjusted to accommodate its load but to secure and restrain it as well. This strap also prohibits the bonnet from flapping freely when open and thus reduces the chance it will inadvertently catch while a firefighter is traveling.

A third, vertically disposed reinforcement strap 62 extends downward from the top end of load-bearing strap 44 and provides yet more structural integrity to the pouch.

The foregoing constitutes the fundamental and most general design of the bag: viz., a rope containment pouch sewn around and enclosing a contiguous length of fabric strap having rope connecting means at each of its ends, the pouch having snap on/snap off protective bonnet for covering the rope compartment opening.

Numerous additional features of the rope bag may be included to tailor the bag to its anticipated uses and user preferences. For instance, optional features may include a T-shaped fabric strap sewn into the back side of the bag for creating a loop for fastening the bag to an SCBA or trucker's belt.

Figure 5:
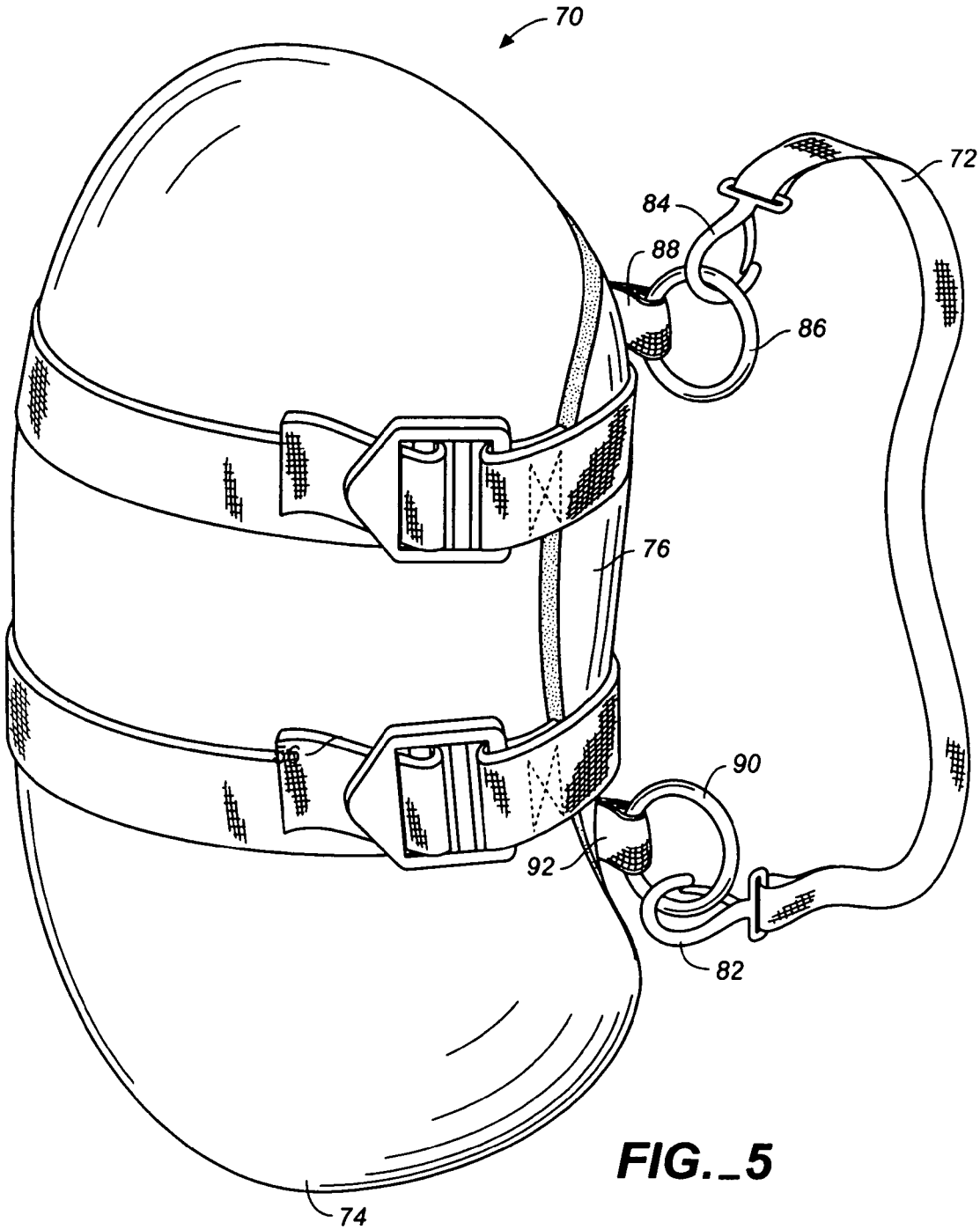
FIG. 5 is a front perspective view of a second preferred embodiment of the firefighter's rope bag and rapid deployment system of the present invention.
Figure 6:
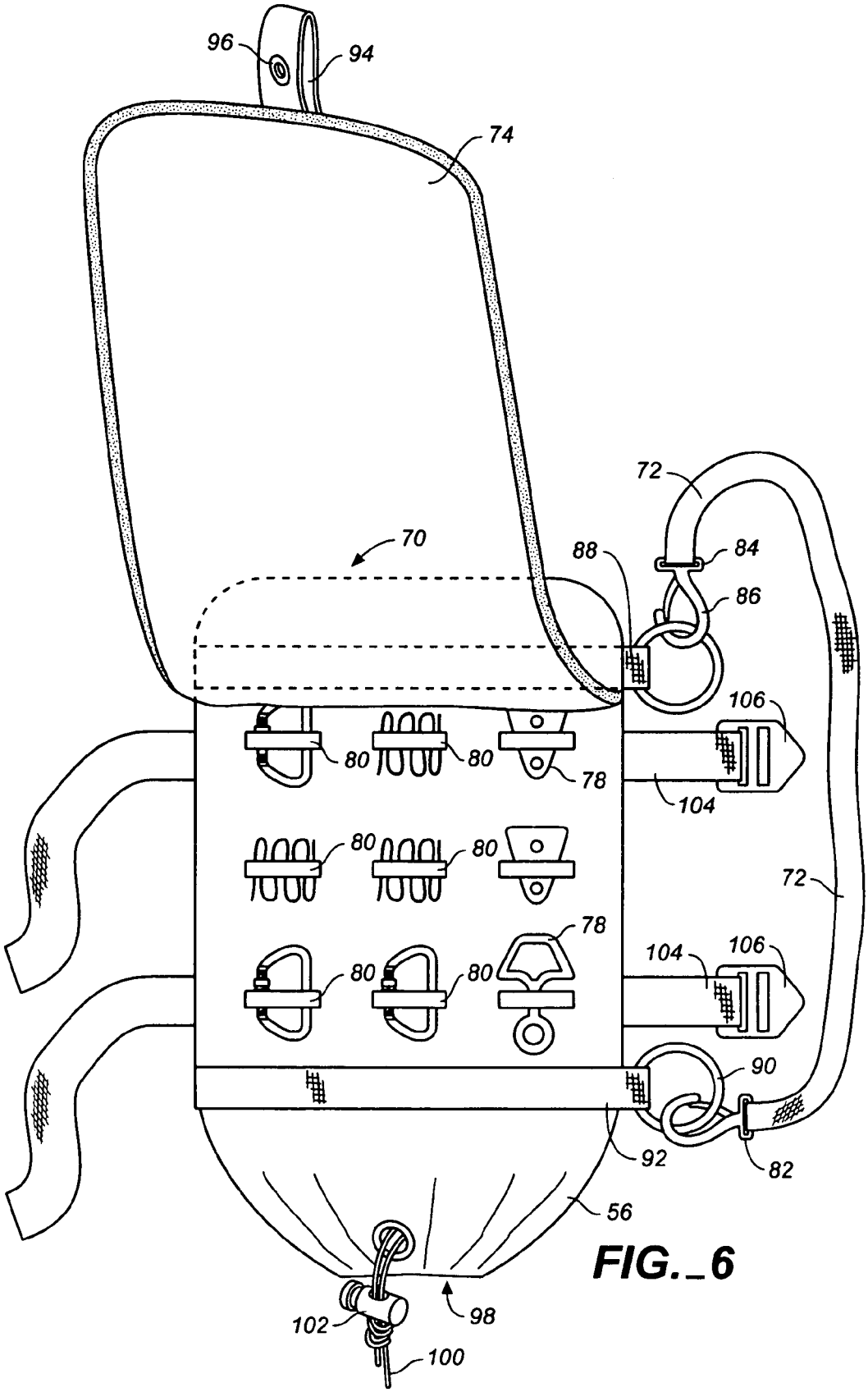
FIG. 6 is a front view showing the rope bag of FIG. 5 open with various rescue equipment and tools exposed.

In an alternative, second preferred embodiment, shown in FIGS. 5–6, the rope bag 70 is adapted for carrying with a shoulder strap 72. In this embodiment, when the protective bonnet 74 is pulled away from the rope pouch 76, an array of rescue equipment 78 is exposed, said equipment retained by elastic or hook and loop straps 80. This embodiment is suited for much longer lengths of rope. Shoulder strap 72 is clipped by clips 82, 84, to an O-ring 86 connected to a load-bearing strap 88 at the upper end of the bag and to an O-ring 90 on an integral transverse strap 92. Again, the bonnet 74 includes an optional strap 94 having a snap 96 for coupling with a complementary snap (not shown) riveted to the pouch side. Further, the pouch includes an opening 98 having an adjustable draw string 100 with a push button spring tensioning clamp 102 for selectively opening and closing the pouch. When a bag of sufficient size is desired, a plurality of fabric straps 104 and buckles 106 may be attached to secure the bonnet, to provide alternative means for carrying the bag, and to attach equipment to the outside of the bag.

In all of the foregoing embodiments the principle of operation entails suspending the bag substantially vertically, unsnapping the protective bonnet and thereby exposing the rope compartment opening, loosening the pull string, fastening the exposed end of the rope (or carabiner) to a fixed object, and deploying the coiled rope outwardly from the pouch while traveling into a structure. This configuration and operation is ideal for rapid deployment in an emergency situation.

It will be readily appreciated that the firefighter need only snap the bag 10 onto his belt using a carabiner 54 connected to O-ring 48 at the upper end of the load-bearing strap 44. He or she then unsnaps the bonnet 30 and loosens the draw string 22 with clamp 28. The rope is now exposed. At its available end, rope 56 may be tied to another carabiner for rapid attachment to a fixed object in the exterior or immediate interior of a building. Alternatively, the rope end may simple be tied to fixed object. The firefighter may then enter the building and the rope will evenly and smoothly feed out from the pouch opening as the firefighter travels into the structure interior. Because the bag and the rope contained within it are each fabricated from heat and fire resistant materials, the operation of the inventive bag will not be impaired when used in the field.

What is claimed as invention is:

1. A firefighter's rope bag, comprising:

a fire retardant rope bag having a closed top and a selectively open bottom, said bag defining a rope-containing compartment;

closure means for closing said open bottom;

a load-bearing strap disposed vertically through said closed top and having a ring at its upper end for connection to a trucker's belt and a ring at its lower end for connection to a rope and/or rope fastening device;

a bonnet having an elastic border which fits over said rope bag bottom when said bottom is closed.

2. A firefighter's rope bag and rapid deployment system, comprising a rope containment pouch having a closed top end and a bottom end with a pouch opening;

closure means for selectively opening and closing said pouch opening;

a load-bearing member having a top end and a bottom end, said top end extending through said closed top end of said rope containment pouch, said bottom end enclosed by said rope containment pouch, and said top and bottom ends each having rope connection means, wherein said load-bearing member is a strip of fabric, and wherein said rope connection means comprises rings secured to said top and bottom ends of said strip of fabric; and a protective bonnet for selectively covering said pouch opening.

3. The firefighter's rope bag and rapid deployment system of claim 2, wherein said rope containment pouch is comprised of two sewn fabric halves.

4. The firefighter's rope bag and rapid deployment system of claim 2, wherein said rope containment pouch is fabricated from fire retardant material.

5. The firefighter's rope bag and rapid deployment system of claim 2, wherein said containment pouch includes an integral loop circumscribing and defining said pouch opening, and wherein said closure means comprises a draw string secured by a clamp.

6. The firefighter's rope bag and rapid deployment system of claim 5, wherein said clamp is a push button tensioning clamp.

7. The firefighter's rope bag and rapid deployment system of claim 2, wherein said protective bonnet comprises a panel of fabric having an elastic edge which allows said bonnet to stretch over and cover the bottom end of said containment pouch when said pouch opening is closed.

8. The firefighter's rope bag and rapid deployment system of claim 2, further including fastening means which permits rapid uncovering of said bonnet from said pouch opening.

9. The firefighter's rope bag and rapid deployment system of claim 8, wherein said fastening means comprises:

a fabric loop sewn into said bonnet and having a bonnet snap; and a pouch snap riveted to said containment pouch for mating with said bonnet snap.

10. A firefighter's rope bag and rapid deployment system, comprising a rope containment pouch having a closed top end and a bottom end with a pouch opening;

closure means for selectively opening and closing said pouch opening, a load-bearing member, said load-bearing member having a top end and a bottom end, said top end extending through said closed top end of said rope containment pouch, said bottom end enclosed by said rope containment pouch, and said top and bottom ends having rope connection means;

a protective bonnet for selectively covering said pouch opening; and a shoulder strap.

11. The firefighter's rope bag and rapid deployment system of claim 10, further including:

a transverse strap disposed proximate said lower end of said rope containment pouch;

a first O-ring fastened to said load-bearing member; and a second O-ring fastened to said transverse strap;

wherein said shoulder strap has clips at each end and is clipped at each end to said first and second O-rings.

12. The firefighter's rope bag and rapid deployment system of claim 11, further including at least one fabric strap having a buckle and sewn to said rope bag to secure said bonnet and for attachment of equipment to the outside of said rope bag.

13. The firefighter's rope bag and rapid deployment system of claim 11, further including tool-holding means for attaching a plurality of firefighting tools.

14. The firefighter's rope bag and rapid deployment system of claim 13, wherein when said protective bonnet is pulled away from said rope pouch, said tool-holding means is exposed.

15. The firefighter's rope bag and rapid deployment system of claim 11, wherein said tool-holding means comprises straps sewn onto the side of said rope bag.

* * * * *